United States Patent [19]

Williams et al.

[11] 4,072,619

[45] Feb. 7, 1978

[54] ESTER LUBRICANTS CONTAINING POLYOXYALKYLENE PHENOTHIAZINES

[75] Inventors: Dennis A. Williams; Robert Carswell, both of Lake Jackson, Tex.

[73] Assignee: The Dow Chemical Company, Midland, Mich.

[21] Appl. No.: 718,641

[22] Filed: Aug. 30, 1976

[51] Int. Cl.[2] ..... C10M 1/38

[52] U.S. Cl. ..... 252/47.5; 252/47; 252/56 S; 544/47

[58] Field of Search ..... 252/47, 47.5; 260/243 A

[56] References Cited

U.S. PATENT DOCUMENTS

| | | | |
|---|---|---|---|
| 2,786,080 | 3/1957 | Patton | 252/47.5 X |
| 2,815,343 | 12/1957 | Horsley et al. | 260/243 A |
| 3,376,224 | 4/1968 | Elliott | 252/47.5 |

FOREIGN PATENT DOCUMENTS

| | | | |
|---|---|---|---|
| 640,557 | 5/1962 | Canada | 252/47.5 |

*Primary Examiner*—Helen M. S. Sneed
*Attorney, Agent, or Firm*—Benjamin G. Colley

[57] ABSTRACT

Synthetic ester lubricant blends are described which contain 1–90 weight percent of an N-substituted polyoxyalkylene phenothiazine. The polyoxyalkylene group can be derived from ethylene, propylene, butylene or styrene oxides. The blends have superior oxidative and thermal stability and at the same time have good viscosity characteristics and pour points over a wide range of temperatures.

13 Claims, No Drawings

ESTER LUBRICANTS CONTAINING POLYOXYALKYLENE PHENOTHIAZINES

BACKGROUND OF THE INVENTION

The present invention relates to a lubricant composition comprising an organic ester based synthetic fluid and an N-substituted polyoxyalkylene derivative of phenothiazine having a molecular weight range from about 300 to about 5000.

Polyoxyalkylene derivatives of phenothiazine are known from U.S. Pat. No. 2,815,343. It is well known from the patent literature that substituent groups such as alkyl, alkoxy, aralkyl, aryl,cyanoalkyl and carbalkoxy groups can be substituted on the phenothiazine ring to improve the oxidation stability of lubricants containing minor amonts (i.e., up to 10%) of such modified phenothiazine compounds. Typical examples of such patents are U.S. Pat. No. 3,344,068; 3,642,630; 3,523,910; and 3,518,914.

SUMMARY OF THE INVENTION

It now has been discovered that about 1.0 to about 90 weight percent of N-polyoxyalkylene phenothiazines having a weight average molecular weight range from about 300 to about 5000 can be blended with synthetic ester lubricants to provide lubricant compositions that have superior viscosity and pour point characteristics over a wide range of temperatures and also have superior oxidative and thermal stability. A preferred range of molecular weights for the polyoxyalkylene phenothiazines is from about 375 to about 1300. A preferred range of the amount of the polyoxyalkylene phenothiazines is from about 5 to about 50 weight percent of the blend.

The polyoxyalkylene group of the aforementioned phenothiazines is derived from ethylene oxide, propylene oxide, 1,2-butylene oxide, 2,3-butylene oxide, styrene oxide or any mixture thereof. The only limitation being that when ethylene oxide is used the polyoxyalkylene phenothiazine compounds the amount used must be such that less than about 85% by weight of the compounds is made up from ethylene oxide.

DETAILED DESCRIPTION OF THE INVENTION

The organic esters used herein to make the lubricating synthetic fluids are well known in the art and for the most part are commercially available materials. Typical classes of esters which may be employed herein are:

(A) esters of monohydric alcohols with dicarboxylic acids;
(B) esters of trimethylol ethane with monocarboxylic acid;
(C) esters of trimethylolpropane with monocarboxylic acids;
(D) esters of pentaerythritol with monocarboxylic acids;
(E) esters of glycerine with monocarboxylic acids;
(F) esters of di- or tri-pentaerythritol with monocarboxylic acids;
(G) complex esters prepared from neopentyl glycol, dicarboxylic acids and monocarboxylic acids;
(H) complex esters prepared from neopentyl glycol, dicarboxylic acids and monohydric neo alcohols, e.g. 2,2,4-trimethyl pentanol;
(I) complex esters prepared from trimethylolethane or trimethylol propane, monocarboxylic acids and dicarboxylic acids;

(J) complex esters prepared from pentaerythritol, monocarboxylic acids and dicarboxylic acids;
(K) esters of polyoxyalkylene oxide glycols with monocarboxylic acids.

Examples of the dicarboxylic acids which may be used are adipic, azelaic, and sebacic acids and of the monocarboxylic acids butyric, valeric, caproic, caprylic, capric and pelargonic acids. If desired branched-chain monocarboxylic acids may be employed in the synthesis of the esters. Alternatively, blends of several different esters can be used. Specific examples of these esters are:

Di-(2,2,4-trimethyl pentyl) sebacate
Di-(2,2,4-trimethyl pentyl) azelate
Trimethylolethane tricaproate
Trimethylol propane trivalerate
Trimethylol propane tri-n-heptanoate
Trimethylol propane tri-pelargonate
Trimethylol propane tricaprate
Pentaerythritol tetracaproate
Dipentaerythritol hexacaproate
2-methyl-2-ethyl propane 1:3 diol dipelargonate
Complex esters prepared from trimethylol propane, caproic acid and sebacic acid;
Complex ester prepared from trimethylol propane, butyric acid, and azelaic acid;
Complex ester prepared from neopentyl glycol, sebacic acid, and 2,2,4-trimethyl pentanol.

Alternatively blends of mixed esters may be prepared by esterifying a hindered alcohol with a mixture of acids in a wide range of proportions. Thus, for example, trimethylol propane and esterified with a mixture of caproic acid and capric acid until reaction was complete. The product was further esterified with sebacic acid to yield a mixture of complex and simple esters.

Certain esters derived from pentaerythritol are available commercially from the Hercules Powder Company under the registered trademarks HERCOFLEX and HERCOLUBE.

Of many types of esters it is preferred to employ esters of trimethylol propane or pentaerythritol with straight chain monocarboxylic acids having from 4 to 10 carbon atoms.

One very suitable base fluid comprises a major proportion of a mixture of esters of trimethylol propane with straight chain monocarboxylic acids having from 4 to 9 carbon atoms together with a minor proportion, preferably from 5–30% of a mixture of esters of dipentaerythritol from straight chain monocarboxylic acids having from 2–10 carbon atoms.

The compositions according to the invention may be based upon a synthetic lubricating oil comprising one or more of the conventional-type diesters. Examples of these diesters which may be employed are:

di-2-ethyl hexyl sebacate,
di-3,5,5-trimethyl hexyl sebacate
di-iso- octyl sebacate
di-2-ethyl hexyl azelate
di-iso octyl azelate
di-iso octyl adipate
di-iso tridecyl adipate.

The polyoxyalkylene phenothiazines used in this invention are prepared by the general methods set forth in U.S. Pat. No. 2,815,343 wherein pure or mixed alkylene oxides are reacted with phenothiazine in the presence of an alkali metal hydroxide or alkoxide to form the adducts.

A mixture of alkylene oxides can be reacted with the phenothiazine to give random copolymer adducts or the alkylene oxides can be reacted in sequence to give block copolymer adducts. Specific examples of useful random copolymer adducts are:

N-polyoxypropylene-polyoxybutylene (9:1 weight ratio) phenothiazine of 1000–1200 molecular weight;

N-polyoxypropylene polyoxyethylene (1:1 weight ratio) phenothiazine of 1000–1200 molecular weight;

N-polyoxyethylene-polyoxybutylene (1:1 weight ratio) phenothiazine of 1200–1400 molecular weight;

N-polyoxypropylene-polyoxyethylene (1.3:1 weight ratio) phenothiazine of 2900–3100 molecular weight.

Specific examples of useful homopolymer adducts prepared from the reaction of a pure alkylene oxide and phenothiazine are:

N-polyoxypropylene phenothiazine of 300–400 molecular weight;

N-polyoxypropylene phenothiazine of 1000–1200 molecular weight;

N-polyoxybutylene phenothiazine of 300–400 molecular weight;

N-polyoxybutylene phenothiazine of 1000–1200 molecular weight.

The foregoing esters are blended with the polyoxyalkylene phenothiazines to prepare a base stock lubricant composition. As illustrated in the examples that follow, the blending can be adjusted to prepare a composition having the viscosity desired at the high temperature (450° F) and/or high severity conditions encountered in gas turbine engines. Likewise, the viscosity can be readily adjusted to meet the less stringent conditions (350° F) of diesel engines, air compressors, and the like.

The foregoing blends can be modified, if desired, by the addition of small amounts of extreme pressure additives, metal deactivators, anti-foaming agents, dyes and the like.

Suitable examples of extreme pressure agents are phosphorus ester such as triphenyl phosphate, tri tolyl phosphorothionate and the like.

Suitable examples of metal deactivators are triazoles such as 1,2,3-benztriazole, 3-amino-5-methyl 1,2,4-triazole, 3-amino-5-pyridyl-1,2,4-triazole, dipyridylamines, morpholine, diethanolamines, and the like.

Suitable examples of anti-foaming agents are polydimethyl siloxanes such as Dow Corning's DC-200 and the like.

GENERAL PROCEDURE FOR SYNTHESIS OF PHENOTHIAZINE INITIATED POLYALKYLENE OXIDES

A 4000 ml, electrically heated, stainless steel pressure reactor equipped with agitator, thermocouple, $H_20$ cooling coils, pressure gauge, $N_2$ inlet and alkylene oxide feed inlet was charged with 200 g of phenothiazine, 200 g of dioxane, and 2 g KOH. The reactor was then flushed with $N_2$ so as to remove oxygen, was left with a 10 psig $N_2$ pad and was heated to 110° C. The agitator was turned on, and alkylene oxide was introduced to the kettle at a rate controlled by a positive displacement pump. The pressure was allowed to rise to 50–60 psig and was maintained by controlling the oxide pumping rate. When the desired amount of oxide was fed to the reactor, pumping was stopped and the contents were allowed to react at constant temperature until the pressure became constant at approximately 10–15 psig. The contents were drained, neutralized and distilled under reduced pressure to remove dioxane. The equivalent weight was determined by measuring the percent hydroxyl content of the polyol. From the percent hydroxyl, the molecular weight of the polyol was calculated using the known relationship between percent hydroxyl, molecular weight, and functionality, i.e., $$\text{molecular weight} = \frac{(\text{functionality of Polyol})(1700)}{\%\ \text{hydroxyl}}$$

TABLE I

PRODUCTS MADE FROM PHENOTHIAZINE (PTZ) WITH ETHYLENE, PROPYLENE AND BUTYLENE OXIDES (EO, PO, AND BO)

| Product | Weight PTZ gms | Weight Alkylene Oxide, gms EO | PO | BO | Mol. Wt. |
|---|---|---|---|---|---|
| X5 | 200 | 450 | 450 | — | 1060 |
| X6 | 200 | — | 810 | 90 | 1080 |
| X3 | 200 | — | 900 | — | 1010 |
| X4 | 200 | — | — | 900 | 1040 |
| X53 | 200 | — | 175 | — | 375 |
| X83 | 200 | 1200 | 1600 | — | 300 |

EXAMPLES 1–12

The rate of oxidation of the ester-phenothiazine (PTZ) initiated polyalkyleneoxide blends were compared with the esters alone, and the PTZ polyalkylene oxides alone, by measuring the rate of weight loss of each component alone and the rate of weight loss of the PTZ polyalkylene oxide-ester blends. This test was done on a DuPont 990 Thermogravimetric Analyzer (TGA) as follows:

(1) Approximately 10–20 mg of sample were placed on a platinum boat on the TGA balance.

(2) The balance arm with the boat and sample was in a quartz housing which was placed in an oven at 150° C.

(3) A constant air flow of 20 cc/min. was maintained over the sample.

(4) A x-y recorder recorded the weight of the sample as a function of time at the isothermal setting.

As can be seen in Table II, all esters showed an improvement in stability to oxidative weight loss by blending the various PTZ initiated polyalkylene oxides. The amount of improvement of a particular blend over the ester alone is shown in the comments column. Comparison of different ester base stocks indicates the choice of ester was important to the rate of weight loss, but for a given ester the rate of weight loss was lowered by blending with the PTZ polyols. This lowering of the rate of weight loss was due to inhibition of oxidative breakdown of the ester.

This was shown by comparing the weight % loss/-hour for control 6 (1.67) and Example 5 (0.44) with the weight % loss/hour of Control 7 (0.32). Since no oxidation occurs under $N_2$, the comparable improvement seen in Example 5 over Control 6 was due to the inhibition of oxidative breakdown of the ester. The weight loss that was seen in Example 5 and Control 7 may have been due to the slow volatilization of the ester. The vapor pressure of the TMPTP at 150° C is reported in the literature as 0.95 mm Hg.

TABLE II

Rate of Oxidation of Synthetic Esters, PTZ Polyalkylene Oxides, and Lubricant Blends Thereof at 150° C in Air

| | Formulation | | Rate of Oxidation Weight %/hr. | Comments |
|---|---|---|---|---|
| Control 1 | TMPMT[1] | | 1.76 | commercially available ester |
| Control 2 | X3[2] | | 0.052 | neat |
| Control 3 | X6[2] | | 0.167 | neat |
| Example 1 | TMPMT | 70 wt. % | 0.32 | 5.5 fold increase in stability |
| | with X3 | 30 wt. % | | over Control 1 |
| Example 2 | TMPMT | 30 wt. % | 0.50 | 3.5 fold increase in stability |
| | with X6 | 70 wt. % | | over Control 1 |
| Control 4 | X53[2] | | 4.5 | weight loss primarily due to vaporization of low mol. wt. PTZ adduct |
| Control 5 | X83[2] | | 0.136 | neat |
| Example 3 | TMPMT | 99 wt. % | 0.53 | 3.3 fold increase in stability |
| | with X53[2] | 1 wt. % | | over Control 1 |
| Example 4 | TMPMT | 50 wt. % | 0.53 | 3.3 fold increase over |
| | with X83[2] | 50 wt. % | | Control 1 |
| Control 6 | TMPTP[3] | | 1.67 | commercially available ester |
| Control 7 | TMPTP | | 0.32 | test run under $N_2$ atmosphere rather than air |
| Example 5 | TMPTP | 75 wt. % | 0.44 | 3.8 fold increase in stability |
| | with X3[2] | 25 wt. % | | over Control 6 |
| Example 6 | TMPTP | 32 wt. % | 0.19 | 8.8 fold increase in stability |
| | with X6[2] | 68 wt. % | | over Control 6 |
| Control 8 | DOA[4] | | 8.0 | commercial ester |
| Example 7 | DOA | 66 wt. % | 3.8 | 2.1 fold increase in stability |
| | with X6[2] | 34 wt. % | | over Control 8 |
| Example 8 | DOA | 25 wt. % | 2.0 | 4.0 fold increase over Control 8 |
| | with X6[2] | 75 wt. % | | |
| Control 9 | DDA[5] | | 3.3 | commercial ester |
| Example 9 | DDA | 29 wt. % | 0.9 | 3.7 fold increase over Control 9 |
| | with X6[2] | 71 wt. % | | |
| Example 10 | DDA | 78 wt. % | 2.6 | 1.3 fold increase over Control 9 |
| | with X6[2] | 22 wt. % | | |
| Control 10 | DEA[6] | | 10.0 | commercial ester |
| Example 11 | DEA | 62 wt. % | 2.3 | 4.3 fold increase over Control 10 |
| | with X6[2] | 38 wt. % | | |
| Example 12 | DEA | 23 wt. % | 2.8 | 3.6 fold increase over Control 10 |
| | with X6[2] | 77 wt. % | | |

Footnotes for Table II:
[1]Trimethylol Propane Mixed Triester of $C_7$–$C_9$ alkanoic acids
[2]X3, X6, etc. are identified in Table I
[3]Trimethylol Propane Triester of Pelargonic acid
[4]Di-iso-Octyl Azelate
[5]Di-iso-Decyl Azelate
[6]Di-2-Ethylhexyl Azelate

EXAMPLES 13–16

The stability to viscosity change by oxidative degradation of the PTZ polyol blends of esters was tested. The samples were heated in an oven at 175° C in 4 oz. square bottles for 400 hours. There was approximately 100 g of sample with a surface area of about 1 square inch in each case. As little as 5% of X3 (PTZ initiated polyoxypropylene to 1100 mol. wt.) gave good viscosity stability to the ester. The results were shown in Table III.

As was seen in Table II, the choice of ester has an effect on the stability of the properties of the blend. The low viscosity increase seen for Examples 15 and 16 was due to two facts. The first is that the PTZ polyol stabilized the ester against oxidative breakdown. The second is that the volitility of the TMPTP ester is low. Thus when the aged sample was analyzed the ratio of PTZ polyol and ester was essentially unchanged.

The increase in viscosity of Examples 13 and 14 was due to loss of the ester component of the blend. This was shown by measuring the concentration of PTZ polyol and finding it had increased by an amount directly related to the amount of weight lost by the sample.

Thus, while the original ratio was 3 parts DEA to 1 part X3 in Example 14, the measured ratio after aging in the oven was found to be 1.67 parts DEA to 1 part X3. This loss of DEA accounts for the viscosity increase since it is the lower viscosity component of the blend. The vapor pressure at 175° C of DEA and TMPTP, according to literature data, is given as 3.4 mm Hg and 2.3 mm Hg, respectively.

TABLE III

Viscosity Stability of Ester-PTZ Polyol Blends after Exposure to Air at 175° C for 400 hours

| | Formulation | | % Viscosity Change at 210° F |
|---|---|---|---|
| Control 1 | DEA[1] | | +40 |
| Control 2 | TMPTP[2] | | +46 |
| Control 3 | X3[3] | | + 7 |
| Example 13 | DEA | 54 wt. % | +33 |
| | with X3 | 46 wt. % | |
| Example 14 | DEA | 75 wt. % | +25 |
| | with X3 | 25 wt. % | |
| Example 15 | TMPTP | 75 wt. % | + 7 |
| | with X3 | 25 wt. % | |
| Example 16 | TMPTP | 95 wt. % | + 2 |
| | with X3 | 5 wt. % | |

Footnotes:
[1]Di-2-Ethylhexyl Azelate
[2]Trimethylol Propane Triester of Pelargonic acid
[3]PTZ initiated polyoxypropylene of 1100 mol. wt. prepared as in Table I

TABLE IV

Comparison of Viscosity and Pour Point Properties of Synthetic Esters, X6 and Blends Thereof Suitable as Gas Turbine Lubricant Base Stocks

| | Formulation | Viscosity, cs 210° F | Viscosity, cs 100° F | Pour Point, ° F |
|---|---|---|---|---|
| Control 1 | X6[1] | 24.5 | 281 | + 2 |
| Control 2 | DPD[2] (NEAT) | 2.7 | 9.8 | < − 75 |
| Control 3 | IDP[3] (NEAT) | 1.76 | 5.10 | < −100 |
| Control 4 | TMPMT[4] (NEAT) | 4.17 | 19.6 | − 90 |
| Control 5 | TMPTP[5] (NEAT) | 3.34 | 22.9 | − 70 |
| Control 6 | DOA[6] (NEAT) | 4.76 | 12.7 | − 85 |

TABLE IV-continued

Comparison of Viscosity and Pour Point Properties of Synthetic Esters, X6 and Blends Thereof Suitable as Gas Turbine Lubricant Base Stocks

| | Formulation | Viscosity, cs 210° F | Viscosity, cs 100° F | Pour Point, ° F |
|---|---|---|---|---|
| Control 7 | DEA[7] (NEAT) | 2.96 | 11.0 | −100 |
| Control 8 | DDA[8] (NEAT) | 4.35 | 18.7 | − 95 |
| Example 17 | DPD (59 wt. %) with X6 (41 wt. %) | 6.2 | 31.7 | − 68 |
| Example 18 | IDP (54 wt. %) with X6 (46 wt. %) | 5.99 | 28.8 | <− 80 |
| Example 19 | TMPMT (80 wt. %) with X6 (20 wt. %) | 5.95 | 31.8 | <− 80 |
| Example 20 | TMPTP (87 wt. %) with X6 (13 wt. %) | 6.54 | 36.6 | − 75 |
| Example 21 | DOA (64 wt. %) with X6 (36 wt. %) | 6.09 | 29.3 | <− 80 |
| Example 22 | DEA (62 wt. %) with X6 (38 wt. %) | 6.04 | 30.7 | − 80 |
| Example 23 | DDA (78 wt. %) with X6 (22 wt. %) | 6.03 | 29.09 | <− 80 |

Footnotes:
[1]PTZ initiated polyoxypropylene-polyoxybutylene (9/1) wt. ratios) of 1100 mol. wt. prepared as in Table I
[2]DiPropylene glycol Dipelargonate
[3]IsoDecyl Pelargonate
[4]Trimethylol Propane Mixed Triester of $C_7$–$C_9$ alkanoic acids
[5]Trimethylol Propane Triester of Pelargonic acid
[6]Di-iso-Octyl Azelate
[8]Di-iso-Decyl Azelate

TABLE V

Comparison of Viscosity and Pour Point Properties of Synthetic Esters, X6, and Blends Thereof Suitable as Diesel Engine Lubricant Base Stocks

| | Formulation | Viscosity, cs 210° F | Viscosity, cs 100° F | Pour Point, ° F |
|---|---|---|---|---|
| Control 1 | X6[1] | 24.5 | 281 | + 2 |
| Control 2 | DPD[2] (NEAT) | 2.7 | 9.8 | − 75 |
| Control 3 | IDP[3] (NEAT) | 1.76 | 5.10 | −100 |
| Control 4 | TMPMT[4] (NEAT) | 4.17 | 19.6 | − 90 |
| Control 5 | TMPTP[5] (NEAT) | 4.76 | 22.9 | − 70 |
| Control 6 | DOA[6] (NEAT) | 3.34 | 12.7 | − 85 |
| Control 7 | DEA[7] (NEAT) | 2.96 | 11.0 | −100 |
| Control 8 | DDA[8] (NEAT) | 4.35 | 18.7 | − 95 |
| Example 24 | DPD (22 wt. %) with X6 (78 wt. %) | 14.1 | 112 | − 40 |
| Example 25 | IDP (17 wt. %) with X6 (83 wt. %) | 13.3 | 107 | − 33 |
| Example 26 | TMPMT (30 wt. %) with X6 (70 wt. %) | 13.7 | 112 | − 43 |
| Example 27 | TMPTP (32 wt. %) with X6 (68 wt. %) | 13.4 | 109 | − 40 |
| Example 28 | DOA (25 wt. %) with X6 (75 wt. %) | 13.4 | 105 | − 38 |
| Example 29 | DEA (23 wt. %) with X6 (77 wt. %) | 13.7 | 109 | − 48 |
| Example 30 | DDA (29 wt. %) with X6 (71 wt. %) | 13.3 | 105 | − 45 |

Footnotes:
[1]PTZ initiated polyoxypropylene-polyoxybutylene (9/1 wt. ratios) of 1100 mol. wt. from Table I
[2]DiPropylene glycol Dipelargonate
[3]isoDecyl Pelargonate
[4]Trimethylol Propane Mixed Triester of $C_7$–$C_9$ alkanoic acids
[5]Trimethylol Propane Triester of Pelargonic acid
[6]Di-iso-Octyl Azelate
[7]Di-2-Ethylhexyl Azelate
[8]Di-iso-Decyl Azelate

We claim:

1. A lubricant composition comprising an organic ester based synthetic fluid and about 1 to about 90 weight percent of a phenothiazine having an N-substituted polyoxyalkylene group and having a weight average molecular weight range from about 300 to about 5000 wherein the polyoxyalkylene group is derived from an alkylene oxide selected from ethylene, propylene, butylene, styrene oxides or mixtures thereof with the proviso that less than about 85% by weight of said phenothiazine is derived from ethylene oxide when said polyoxyalkylene group is derived from ethylene oxide.

2. The composition of claim 1 wherein the amount of said substituted phenothiazine ranges from about 5 to about 50 weight percent.

3. The composition of claim 1 wherein the molecular weight of said substituted phenothiazine ranges from about 375 to about 1300.

4. The composition of claim 2 wherein the molecular weight of said substituted phenothiazine ranges from about 375 to about 1300.

5. The composition of claim 1 wherein the organic ester comprises a monoester of a monocarboxylic acid.

6. The composition of claim 1 wherein the organic ester comprises a diester of a dicarboxylic acid and a monofunctional alcohol.

7. The composition of claim 1 wherein the organic ester comprises a triester of a trifunctional alcohol and a monocarboxylic acid.

8. The composition of claim 1 wherein the organic ester comprises a diester of a difunctional alcohol and a monocarboxylic acid.

9. The composition of claim 1 wherein the organic ester comprises a tetraester of a tetrafunctional alcohol and a monocarboxylic acid.

10. The composition of claim 2 wherein the substituted phenothiazine is N-polyoxypropylene-polyoxybutylene-phenothiazine of 1000–1200 molecular weight having a 9:1 weight ratio of oxypropylene groups to oxybutylene groups.

11. The composition of claim 2 wherein the substituted phenothiazine is N-polyoxypropylene-polyoxyethylene-phenothiazine of 1000–1200 molecular weight having a 1:1 weight ratio of oxypropylene groups to oxyethylene groups.

12. The composition of claim 2 wherein the substituted phenothiazine is N-polyoxyethylene-polyoxybutylene-phenothiazine of 1200–1400 molecular weight having a 1:1 weight ratio of oxyethylene groups to oxybutylene groups.

13. The composition of claim 2 wherein the substituted phenothiazine is N-polyoxypropylene-polyoxyethylene of 2900–3100 molecular weight having a 1.3:1 weight ratio of oxypropylene groups to oxyethylene groups.

* * * * *

UNITED STATES PATENT AND TRADEMARK OFFICE

CERTIFICATE OF CORRECTION

PATENT NO. : 4,072,619

DATED : Feb. 7, 1978

INVENTOR(S) : D. A. Williams & R. Carswell

It is certified that error appears in the above-identified patent and that said Letters Patent are hereby corrected as shown below:

Column 1, line 16; "amonts" should read as -- amounts --.

Column 1, line 39; should read as -- is used to made the --.

Column 2, line 33; should read as -- until the reaction --.

Column 2, line 40; should read as -- Of the many --.

Column 4, line 49; should read as -- with various PTZ --.

Column 6, line 68 (Control 5), under Column entitled "Viscosity, 210°F"; should read -- 4.76 --.

Column 6, line 69 (Control 6), same column; should read -- 3.34 --.

Signed and Sealed this

Thirtieth Day of May 1978

[SEAL]

Attest:

RUTH C. MASON
Attesting Officer

LUTRELLE F. PARKER
Acting Commissioner of Patents and Trademarks